United States Patent [19]

Bartels

[11] 4,360,738

[45] Nov. 23, 1982

[54] SINGLE PROBE LOW WATER CONTROL

[75] Inventor: James I. Bartels, Hudson, Wis.

[73] Assignee: Honeywell Inc., Minneapolis, Minn.

[21] Appl. No.: 260,232

[22] Filed: May 4, 1981

[51] Int. Cl.[3] ..... G08B 21/00; G01F 23/00

[52] U.S. Cl. ..... 307/118; 340/620

[58] Field of Search ..... 307/118; 73/304; 340/620

[56] References Cited

U.S. PATENT DOCUMENTS

| | | | |
|---|---|---|---|
| B 451,396 | 4/1976 | Nurnberg . | |
| 3,457,464 | 7/1969 | Wallentowitz | 317/142 |
| 3,555,289 | 1/1971 | Sobkow | 307/118 |
| 3,641,544 | 2/1972 | Radin | 340/244 C |
| 3,892,982 | 7/1975 | Holmes | 307/118 |
| 4,027,172 | 5/1977 | Hamelink | 307/118 |
| 4,110,740 | 8/1978 | Akita et al. | 340/620 |
| 4,263,587 | 4/1981 | John | 340/620 |

*Primary Examiner*—Donald A. Griffin

*Attorney, Agent, or Firm*—Alfred N. Feldman

[57] ABSTRACT

A timer means having a time delay on reapplication of control allows a single probe low water cutoff and feedwater makeup device to function. The time delay preventing reapplication of power to a burner while simultaneously causing a feedwater mechanism to add water to a boiler provides safe operation of the boiler without oscillations caused by momentary losses of water.

9 Claims, 2 Drawing Figures

SINGLE PROBE LOW WATER CONTROL

CROSS-REFERENCE TO RELATED APPLICATION

The present application discloses a power supply disclosed in an application filed on Feb. 17, 1981 having Serial No. 235,254 in the name of the present applicant and assigned to the assignee of the present application.

BACKGROUND OF THE INVENTION

Boilers that provide hot water and steam for heating and processing of manufactured goods must be carefully monitored to ensure the presence of adequate water. The failure to maintain an adequate water supply in a boiler can be hazardous. If the water level in a boiler drops below a safe level the boiler can be damaged, and even more seriously it can explode. In view of this, the monitoring of the water level in boilers is a rather critical control function.

In a typical boiler there are two boiler water sensing devices. Normally one device monitors the level of the boiler water and controls the burner that fires the boiler. The other sensing device normally monitors the water level and controls a feedwater pump or valve to add water to the boiler when necessary. These two functions cannot normally be combined due to the spontaneous variations in boiler water level due to the heating of the water, which causes an erradic flow or change in the water level. If a typical single probe is used to control the burner and the feedwater source, the moment the sensing mechanism determines that more water is necessary, the burner is turned off. If the water at the sensing means or probe is quickly restored, the feedwater is turned off and the burner is reignited. This function can oscillate causing a very undesirable cycling of the entire system.

In prior art systems thermal types of delays have been used for control with one of the two normal sensing probes. The thermal type delays have a relatively long delay time in operation, and further have the undesirable function of requiring a recycled time due to the thermal mass of the delaying element. Due to the nature of a thermal delay and its cycling rate, the application of a thermal time delay device to the probes used in a boiler limit their application.

SUMMARY OF THE INVENTION

In the present invention a single probe element is used for both low water cutoff and feedwater control. The single probe means has two probe elements, with one of the elements typically ground to the boiler shell itself. A potential is applied between the probe elements and an amplifier measures for the presence or absence of boiler water.

Under normal running conditions the water level is sufficient so that a resistance path is established through the water between the two probe elements. This allows for the amplifier to pull in a relay which open circuits the feedwater control circuit, and closes the fuel burner control circuit. This allows for the fuel burner to operate while the feedwater source is disconnected. At the same time a third contact on the relay closes in an electronic timing circuit to prepare the circuit for a short timed interval in the event that the relay drops out.

Upon the water level in the boiler dropping beyond the probe element designed to sense the water, the circuit is broken and the output relay drops out. The dropping out of the relay allows for the contact in the electronic time delay means to be activated. This time delay means disables the portion of the control that would allow the return of water to take over control by pulling the relay in once again. Once the relay has dropped out, the feedwater source is energized adding water for a fixed time delay period without allowing the burner to recycle. When the time delay period ends, the system is put into normal operation and the burner is allowed to be brought on while the feedwater source is disconnected, if water has returned to the probe.

The present arrangement, by means of a time delay for adding feedwater to the boiler regardless of the sensing of the probe, provides a control circuit arrangement that is capable of operating a boiler to both sense the boiler water level and to control the feedwater source through the expedient of a single probe means.

DESCRIPTION OF THE PREFERRED EMBODIMENTS

Figure 1:
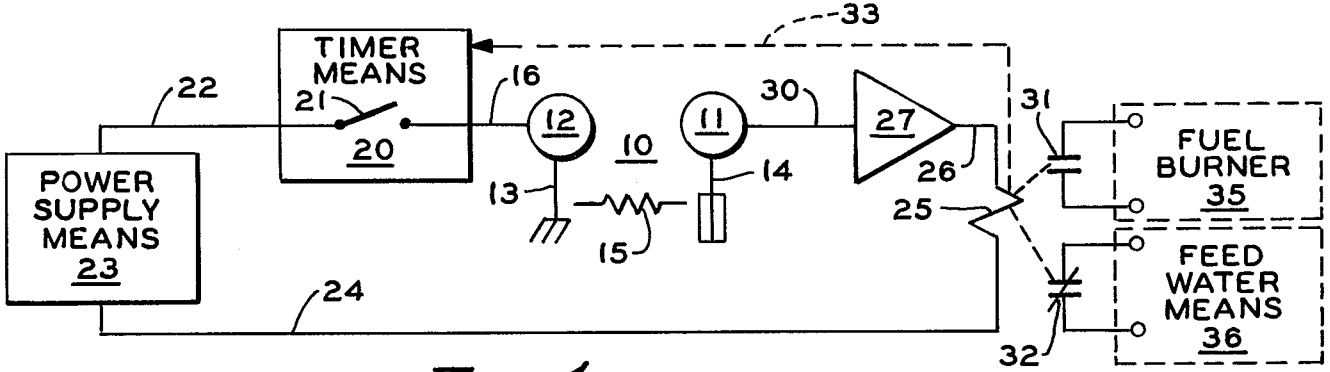
FIG. 1 is a block diagram circuit of the improved single probe control.

In FIG. 1 a block diagram is disclosed that incorporates the present invention. In this diagram a boiler water probe means is generally disclosed at 10 having a probe connection 11 and a ground 12. The ground 12 normally is the wall of the boiler in which the probe 10 is inserted, and the ground connection is shown at 13. The probe is completed by a conductor 14 that projects down into water 15, that has been shown as existing as a resistance value between the boiler 13 and the conductor 14.

The means 10 is energized by a conductor 16 that in turn is connected to a timer means 20 that is shown as having an open switch 21. The function of the timer means 20 will be described in connection with the operation of the device. The timer means 20 is connected by a conductor 22 to a power supply means 23 which in turn is connected by conductor 24 to one side of a relay 25. The other side of relay 25 is connected by conductor 26 to an amplifier means 27 that in turn is connected by a conductor 30 to the probe element 11 of the probe means 10. The relay 25 has two additional sets of contacts. The first set of contacts is shown at 31 as a normally open pair of contacts, while the second pair of contacts 32 is disclosed as a normally closed pair of contacts. The relay 25 further has a feedback circuit or connection disclosed at 33 that connects back to the timer means 20. The feedback means 33 in effect operates the switch 21 which could be a normally open relay contact that is operated by the relay 25.

The relay 25 is used to control a fuel burner, and a feedwater makeup water arrangement that can be a pump or a water valve. More specifically, the normally open contact 31 is adapted to control the fuel burner disclosed at 35, while the normally closed contact 32 is adapted to control the feedwater makeup means 36.

OPERATION OF FIG. 1

It is assumed that the system disclosed in FIG. 1 is functioning in a proper manner with water 15 present between the ground 13 and the conductor 14 of the probe means 10. Under these circumstances the power supply means 23 is capable of completing a circuit through the relay 25, the amplifier means 27, and the water 15 at the probe means 10. The relay 25 is energized with the contact 21 in the timer means being closed. With this arrangement, the normally open contact 31 controlling the fuel burner 35 is closed to properly energize the fuel burner, while the normally closed contact 32 that controls the feedwater makeup means 36 is open. Under these circumstances, the boiler will be properly heated and the feedwater will be turned off.

In the event that the water 15 in the boiler drops sufficiently to remove the resistance 15 from the circuit, the amplifier means 27 causes the relay 25 to be deenergized. The normally closed contact 32 closes to energize the feedwater makeup control, while the normally open contact 31 opens and turns off the fuel burner 35. Under these circumstances water will be added to the boiler. If it is assumed that water immediately establishes the resistance 15, the system will not return the fuel burner 35 to operation. The timer means 20 will not allow a completion of an electric circuit between the conductors 16 and 22 until a fixed time interval has occurred. In a typical boiler installation the time delay used is in the range of 10 to 15 seconds. This allows for water to rise in the boiler to a sufficient level to avoid an intermittent or hunting action by minor variations in water level causing the amplifier means 27 to pull in and drop out the relay 25. By adding water to the boiler for a short, fixed period of time, the water level is reestablished in a stable manner and the relay 25 is pulled in to reenergize the fuel burner 25 and to disconnect the power to the feedwater makeup means 36. This assumes that no major loss of water has been occurring. The short interval of the timer means 20 ensures that the system operates in a stable manner without causing the relay 25 to cycle unnecessarily thereby trying to start the burner means 35, and intermittently energizing the makeup water means 36. Once the stable operation has occurred, the timer is automatically reset to zero and will again function in the event that the water 15 drops to a level to remove the conductive path between the ground 13 and the probe conductor 14.

Figure 2:
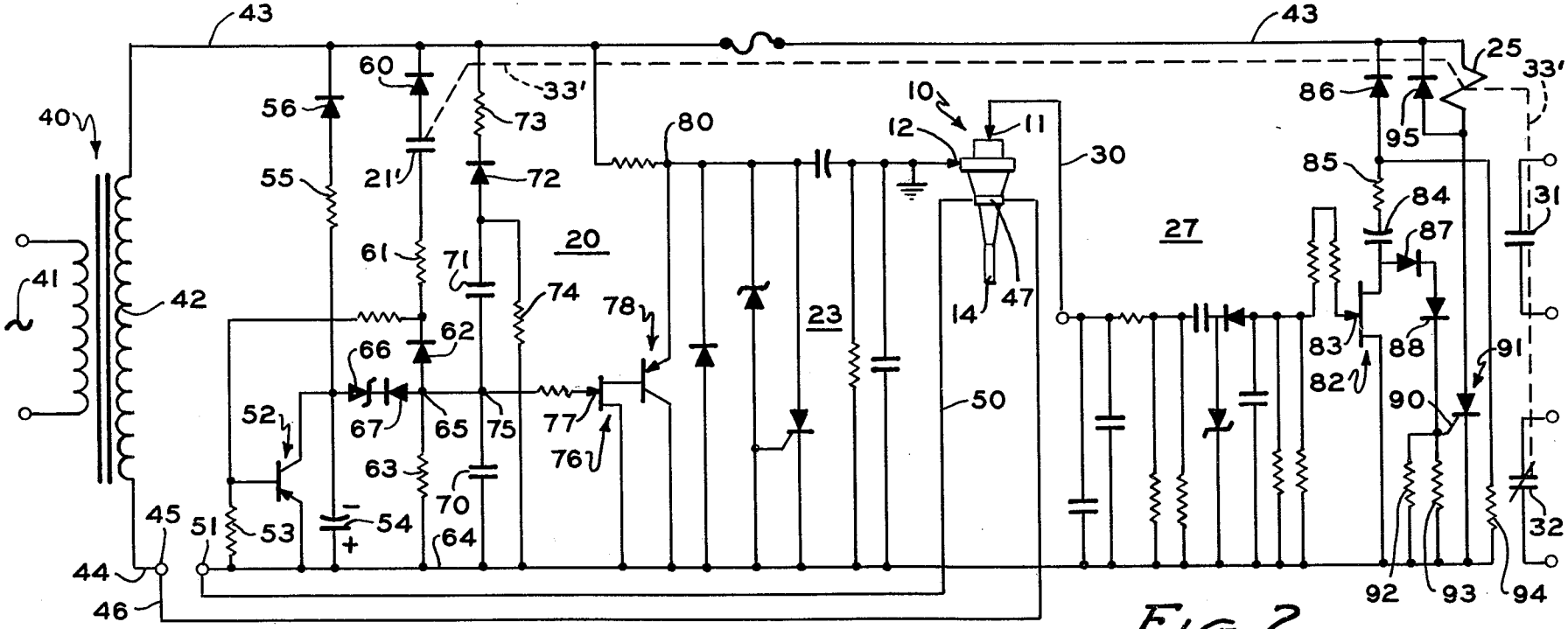
FIG. 2 is a schematic diagram of a complete single probe water control circuit using the present invention.

The disclosure in FIG. 1 is a block diagram arrangement merely as a means of explaining the novel concept of the present invention. In FIG. 2 there is disclosed a complete and detailed circuit diagram of a single probe low water cutoff and water makeup control that utilizes a three element safety type of probe means. The probe means itself, and its method or means of operation, is disclosed in the Hamelink U.S. Pat. No. 4,027,172. While the disclosure of FIG. 2 incorporates the probe disclosed in the Hamelink patent, the invention can be readily applied to a two element probe means as disclosed in FIG. 1.

The complete control circuit of FIG. 2 will utilize reference numerals that correspond with FIG. 1 where appropriate. A step down transformer is generally disclosed at 40 to step down the line voltage 41 to a low voltage secondary 42 of the transformer 40. The output of the secondary winding is between a pair of conductors 43 and 44. Conductor 44 is connected to a terminal 45 which in turn is connected to a wire 46 that is connected to a guard ring 47 of the probe means 10. The guard ring 47 is connected by a further conductor 50 to a terminal 51, and effectively is nothing more than a continuation of the conductor 44. The function of the guard ring 47 of the probe means 10 can be found detailed in the Hamelink patent. For the present disclosure, the circuit can be considered nothing more than a short across the terminals 45 and 51.

The power supplied on conductors 43 and 44 is effectively applied to the timer means 20 which includes in its input a transistor 52 that is biased by a resistor 53 and which is paralleled by a timing capacitor 54. The transistor 52 and the timing capacitor 54 are connected through a resistor 55 and a diode 56 to the conductor 43 so that the capacitor 54 can take on a charge of the polarity indicated. The timer means 20 further includes a normally open contact 21' that is operated by the linkage 33' from the relay 25 that acts as the output or control relay for the device. The normally open contact 21' is connected by a diode 60 to the conductor 43. The normally open contact 21' is further connected through a resistor 61, a diode 62, and a resistor 63 to a conductor 64 which is an extension of the conductor 44. The circuit including the resistor 63, the diode 62, the resistor 61, the normally open contact 21' and the diode 60 forms a biasing circuit at the junction 65 between the resistor 63 and the diode 62. The use of the bias will be described in connection with the operation of the timer means 20. Connected between the junction 65 and the transistor 52 is a zener diode 66 and a further conventional diode 67. The zener diode 66 provides a voltage drop of approximately 10 volts in coupling the voltage from the timing capacitor 54 to the control junction 65.

The timer means 20 further includes a voltage divider made up of the capacitors 70 and 71 connected in a series circuit through a diode 72 and a resistor 73 to the conductor 43 from the conductor 64. A resistor 74 parallels the combination of the capacitors 70 and 71. The voltage divider made up of the capacitors 70 and 71 has a junction 75 that is common with the junction 65 and is part of a safety startup circuit for the timer means 20.

The timer means 20 is completed by a field effect transistor generally disclosed at 76 which has a gate 77 that controls the conductivity of the field effect transistor 76. The field effect transistor 76 controls a conventional transistor 78 that is connected between junction 80 and the conductor 64. The transistor 78 acts as the output component for the timer means 20. The transistor 78 is held in a nonconductive state when the overall system is in normal operation, and is allowed to be conductive for a timed interval or the fixed time delay period.

The transistor 78 is connected across the input to the power supply means 23 for the system. The power supply means 23 effectively provides power to the probe means 10 between the ground 12 and the probe element 11. For all practical purposes the power supply means 23 can be considered an alternating current type of power supply which has an equal amount of electrical energy in each half of the wave form. The particular power supply means 23 disclosed in FIG. 2 is the specific power supply means disclosed in the pending application serial number 235,254 which was filed on Feb. 17, 1981 in the applicant's name and which is assigned to the assignee of the present invention. While the power supply means 23 has been shown as this type of a power supply, any type of powering means between the ground 12 and the element 11 of the probe means 10 which is capable of causing current to flow through water 15 to provide a sensing signal for the amplifier section of the device is suitable for the present invention. As such, no further details of the power supply means 23 are believed necessary beyond the fact that the transistor 78 is capable of shorting out the power supply means 23 when the transistor 78 conducts.

The probe means 10 is further connected by the conductor 30 to an amplifier means 27. The amplifier means 27 is a conventional type of amplifier and will not be described in detail. An amplifier of the type disclosed in the Hamelink patent is applicable, and the only part of the amplifier that will be mentioned is an output field effect transistor 82 that has a gate 83 to control the field effect transistor 82. The amplifier means 27 controls the gate 83 of the field effect transistor 82 to allow a charge to be accumulated on a capacitor 84 through a resistor 85 and a diode 86 to the power supply conductor 43. The capacitor 84 is connected through a pair of diodes 87 and 88 to the gate 90 of a silicon controlled rectifier generally disclosed at 91. The silicon controlled rectifier has a pair of gating resistors 92 and 93 which are conventional in function and which have been shown as redundant resistors for safety. The silicon controlled rectifier 91 is connected in series with the relay 25 and it is obvious that when the silicon controlled rectifier conducts that the relay 25 is energized between the conductor 43 and the conductor 64. The output circuit of the amplifier means 27is completed by a resistor 94 and a diode across the relay shown at 95. The relay 25 is again shown coupled at 33' to the normally open contact 31 and the normally closed contact 32, as is shown in FIG. 1.

OPERATION OF FIG. 2

If it is assumed that a normal water level exists in the boiler and that power has just been applied to the system, the capacitors 70 and 71 of the timer means 20 will immediately take on a charge through the diode 72 and resistor 73. The voltage at junction 75 will bias the gate 77 of the field effect transistor 76 so as to prevent the transistor 78 from conducting. This allows the power supply means 23 to supply power to the probe means 10. Since water was assumed to be present, the probe means 10 will cause the amplifier 27 to energize the relay 25 closing the contact 31 and opening the contact 32. The fuel burner control 35 will be energized and normal operation will occur. The capacitor 70 discharges through the resistor 63, but since the contact 21' has closed, a voltage will continue to appear at junction 65 that keeps the field effect transistor 76 in a nonconductive state thereby causing the transistor 78 to remain nonconductive. During this same interval of time the capacitor 54 is prevented from charging by conduction through the resistor 55 and the diode 56 because the transistor 52 is conductive. The necessary biased voltage continues to appear at junction 75 to keep the field effect transistor 76 in a nonconductive state thereby allowing the power supply means 23 to continue normal operation of the system.

If water now drops below the end of conductor 14 of the probe means 10, the amplifier 27 causes the relay 25 to drop out. The dropping of the relay 25 causes the contact 31 to open along with the opening of the contact 21'. At this same time the normally closed contact 32 closes. The closing of the contact 32 immediately starts the feedwater mechanism to add water to the boiler. The opening of the contact 31 deenergizes the fuel burner. The opening of contact 21' sets a time delay function in operation within the timer means 20.

The transistor 52 is taken out of conduction since its base circuit has now been opened by the opening of the contact 21'. The opening of contact 21' also removes the bias from the gate 77 of the field effect transistor 76 causing it to conduct which in turn causes transistor 78 to conduct. This initiates the time delay by shorting the power supply means 23 for the probe means 10. Without power being supplied to the probe means 10, the probe means 10 cannot cause the amplifier means 27 to energize the relay 25 until a finite time delay interval of approximately 12 seconds has occurred. Capacitor 54 is now allowed to take on a charge of between 13 and 14 volts which takes approximately 12 seconds. The voltage appearing across the capacitor 54 is coupled through the 10 volt zener diode 66 to the junction 65 and the junction 75 and applies this voltage to the gate 77 of the field effect transistor 76. Voltage at the gate 77 of the field effect transistor 76 turns it and transistor 78 off, thus removing the short across power supply means 23 and terminating the time delay.

The time delay interval allows for water to be added to the boiler for this fixed period of time. This allows the water level to be raised so that the reapplication of power by the power supply means 23 after the timing interval will put the system back into normal operation if the water level is normal. If the water level has not come back to normal, the system will continue to feed water while continuing to monitor for its return. Normally the contact 32 of the feedwater system is also connected to an alarm and will provide the necessary alarm function.

The time delay provided by the present novel arrangement prevents the system from oscillating by water momentarily touching the end of the probe means 10. This would occur if the time delay function were not provided and an unstable and undesirable cycling of the feedwater mechanism would occur. The present invention allows for the use of a single probe means 10, either of a dual element or of the guard ring variety disclosed in the Hamelink patent, to be used both to provide the low water cutoff function and to provide the feedwater makeup function that is normally provided by a second probe or control. The present arrangement simplifies the installation of boiler control equipment by requiring only a single opening into the boiler rather than two openings. The circuitry shown, that is the control for either a conventional two element probe or for the guard ring type of probe, the amplifier, the power supply, or the particular type of time delay circuit can be varied extensively by those skilled in the electronics art. Since the present invention is subject to many variations in the detailed circuitry, the applicant wishes to be limited in the scope of his invention solely by the scope of the appended claims.

The embodiments of the invention in which an exclusive property or right is claimed are defined as follows:

1. A single probe low water cutoff and makeup water control, including: probe means having a first probe element adapted to normally be in contact with water in a boiler; said probe means further having a second probe element adapted to mount said probe means in a wall of said boiler; power supply means connected to said probe means to apply an electric potential between said elements; amplifier means connected to said probe means to detect the presence or absence of water between said probe elements by measuring the presence or absence of a current flow through the boiler water caused by said potential; said amplifier means including switching means having normally open circuit means and normally closed circuit means when water is absent from said boiler; said normally open circuit means adapted to control fuel burner means for said boiler and said normally closed circuit means adapted to control makeup water means for said boiler; and time delay means responsive to said amplifier means to initiate a time delay upon said normally closed circuit means closing after once having been opened by a change in water level at said probe means, and retaining its closed state for a fixed time delay period regardless of a subsequent change in water level at said probe means.

2. A single probe low water cutoff and makeup water control as described in claim 1 wherein said second probe element is in electrical contact with said boiler.

3. A single probe low water cutoff and makeup water control as described in claim 2 wherein said power supply means causes a voltage to be impressed between said probe elements that alternates in polarity; said voltage having a substantially equal electrical energy content in each polarity of the alterations of said voltage.

4. A single probe low water cutoff and makeup water control as described in claim 3 wherein said switching means includes a relay with said normally open circuit means, including normally open contact means, and said normally closed circuit means including normally closed contact means.

5. A single probe low water cutoff and makeup water control as described in claim 4 wherein said time delay means is an electric time delay means including impedance means and capacitor means to provide said time delay.

6. A single probe low water cutoff and makeup water control as described in claim 5 wherein said time delay means further includes a pair of contacts of said normally open contact means of said relay; said pair of contacts operating to initiate said time delay.

7. A single probe low water cutoff and makeup water control as described in claim 2 wherein said switching means includes a relay with said normally open circuit means including normally open contact means, and said normally closed circuit means including normally closed contact means.

8. A single probe low water cutoff and makeup water control as described in claim 7 wherein said time delay means is electric time delay means including impedance means and capacitor means to provide said time delay.

9. A single probe low water cutoff and makeup water control as described in claim 8 wherein said time delay means further includes a pair of contacts of said normally open contact means of said relay; said pair of contacts operating to initiate said time delay.

* * * * *